US006845585B2

(12) United States Patent
Callander et al.

(10) Patent No.: US 6,845,585 B2
(45) Date of Patent: Jan. 25, 2005

(54) APPARATUS FOR DISPLAY OF MEMORABILIA

(76) Inventors: Rod Callander, 48 Pleasant Street, Pascoe Vale, Victoria (AU), 3044; Les White, 118 Wallaby Drive, Greendale, Victoria (AU), 3341

( * ) Notice: Subject to any disclaimer, the term of this patent is extended or adjusted under 35 U.S.C. 154(b) by 0 days.

(21) Appl. No.: 10/193,401

(22) Filed: Jul. 11, 2002

(65) Prior Publication Data

US 2002/0174584 A1 Nov. 28, 2002

Related U.S. Application Data

(63) Continuation-in-part of application No. 09/903,076, filed on Jul. 11, 2001, now Pat. No. 6,442,879.

(30) Foreign Application Priority Data

Jan. 29, 2001 (AU) ..... PR2745

(51) Int. Cl.[7] ..... B65D 73/00

(52) U.S. Cl. ..... 40/800; 206/486; 206/461; 206/462

(58) Field of Search ..... 40/800; 206/486, 206/461, 462

(56) References Cited

U.S. PATENT DOCUMENTS 2,931,494 A * 4/1960 Pfohl ..... 206/462
3,062,366 A * 11/1962 Palmer ..... 206/462
3,912,082 A * 10/1975 Gerner et al. ..... 206/531
4,187,703 A 2/1980 Ippoliti et al.
4,261,462 A * 4/1981 Wysocki ..... 206/463
4,653,642 A 3/1987 Hakun et al.
4,981,213 A * 1/1991 Dillon ..... 206/469
5,845,778 A 12/1998 Hickey, Jr.
6,128,840 A 10/2000 Boisvert

* cited by examiner

*Primary Examiner*—Cassandra Davis

(57) ABSTRACT

An assembly for displaying an item of memorabilia in three-dimensions including: a rigid support substrate for mounting on a wall; a protective layer adapted to co-extensively abut a part of a surface of the rigid support, said protective layer including an opening therein; a memorabilia display housing, said housing including a shaped portion to receive a three-dimensional shaped item of memorabilia of similar size to the shaped portion, said shaped portion having at least a transparent or translucent viewing part; and in an assembled condition a part of the housing is held by the protective layer or the rigid support and an item of memorabilia is received within the shaped portion of the housing so as to enable display in a three-dimensional form.

13 Claims, 6 Drawing Sheets

APPARATUS FOR DISPLAY OF MEMORABILIA

FIELD OF THE INVENTION

This application is a continuation-in-part application of U.S. patent application Ser. No. 09/903,076, filed on Jul. 11, 2001 , now U.S. Pat. No. 6,442,879, which is incorporated by reference as if fully set forth. The present invention relates to a modification to a multi-component apparatus which is adapted to enclose an item of memorabilia so that the item can be displayed clearly in three-dimensions for posterity.

BACKGROUND OF THE INVENTION

The present applicant has had occasion to preserve and present an item of memorabilia. Of particular interest to the present applicant are of items of sporting memorabilia although it is understood that memorabilia can take the form of artistic, historical, political or social items.

Given the developing commercial nature and appeal of memorabilia, particularly in sporting items, there is a real need for a means of both preserving and displaying such memorabilia.

Previously the present Applicants have filed an Australian Petty Patent application (Application No. 25287/00) which is directed to preserving an item of memorabilia by providing effectively a moulded shaped transparent layer, shaped to conform to an item of memorabilia, and a planar substrate.

It has been found by the applicants that their earlier attempts at manufacturing the apparatus according to petty patent No. 25287/00, too expensive. The Applicants have also experienced noticeable flaws/imperfections in the transparent layer which occurs during the moulding process. These flaws manifest in discrete points of opaqueness/cloudiness and are particularly noticeable in planar surfaces surrounding the shaped area. Even further disadvantages noticed by the Applicants in their earlier attempts to provide a suitable assembly for displaying memorabilia is that the transparent layer is easily scratched. This becomes a significant problem because the transparent layer constitutes the entire top surface of the assembly. During handling and transport of the earlier assembly, scratching or scoring of the transparent layer occurs, whether in shaped or non-shaped moulded regions, and detracts from the overall visual appearance and commercial appeal of the fully assembled article.

Therefore there is a need to provide an apparatus or assembly which is cheaper to produce, does not exhibit or is prone to imperfections, is more readily transported, while still retaining the feature of preserving and displaying an item of memorabilia in three dimensions.

SUMMARY OF THE INVENTION

The objects of the invention are now addressed in a first aspect by an improved assembly for preserving and displaying an item of memorabilia in three-dimensions including:

- a first planar substrate, said first substrate having an opening adapted to receive a transparent shaped memorabilia enclosure;
- a second hard transparent layer, said transparent layer adapted to co-extensively abut a surface of said first substrate, said transparent layer having an opening therein corresponding to said opening in said first substrate;
- a transparent memorabilia enclosure adapted to fit securely within said openings of said first substrate and said second layer wherein the transparent memorabilia enclosure has a shaped portion so as to receive an item of memorabilia of corresponding shape said enclosure extending upwardly through said openings sitting proud of said transparent layer thus displaying an item of memorabilia held therein in three dimensions.

Because the transparent memorabilia enclosure does not form an outer layer of the assembly, it is significantly easier and cost effective to manufacture in commercial quantities and can be made from harder scratch-resistant material. Hence the present assembly enables an item of memorabilia to be displayed more clearly than prior art assemblies.

In a second aspect of the invention there is disclosed a method of preserving and displaying an item of memorabilia including an apparatus including:

- a first planar substrate, said first substrate having an opening adapted to receive a transparent shaped memorabilia enclosure;
- a second hard transparent layer, said transparent layer adapted to be co-extensively abut a surface of said first substrate, said transparent layer having an opening therein corresponding to said opening in said first substrate;
- a transparent memorabilia enclosure adapted to fit securely within said openings of said first substrate and said second layer wherein the transparent memorabilia enclosure has a shaped portion so as to receive an item of memorabilia of corresponding shape said enclosure extending upwardly through said openings sitting proud of said transparent layer thus displaying an item of memorabilia held therein in three dimensions;
- placing said item within said displaying enclosure, placing said enclosure within said opening in, said first substrate, and adhering said second transparent layer onto said first substrate.

Preferably the transparent memorabilia enclosure includes a planar region, extending about the periphery of the shaped portion which is adapted to abut an inner surface of the first substrate away from the transparent layer. In use the planar region abuts against an inner surface of the first substrate so as to be hidden from a viewer's plan view of said shaped portion.

Preferably the planar region and the shaped portion of said memorabilia enclosure are joined substantially at right angles to each other.

Preferably the apparatus further includes an opaque backing board so as to sandwich the planar region of said enclosure between said backing board and said first substrate.

It is further preferred that one or more information plaques and/or one or more photographs is included in the apparatus.

Materials suitable for the construction of the transparent layer include vacform™ PETG, hard acrylics, glass or any rigid or semi-rigid transparent plastic.

The present invention effectively hides any areas of imperfection in the enclosure, particularly at the junction between the shaped portion and the peripheral planar region, and planar regions, which may occur during plastic moulding. As stated previously planar regions of the memorabilia enclosure tend to be prone to flaws which are formed during the moulding process. Any planar regions in the instant invention are hidden from view in the present arrangement. As a result a harder material can be adopted as the transparent layer which provides higher resistance to scratching.

In a third aspect of the invention there is disclosed an improved assembly for protecting and displaying an item in three-dimensions including:

a support substrate;

a protective external layer which mounts at least partially co-extensively on to the first substrate, the protective layer further including an opening;

a memorabilia enclosure at least partially transparent, the enclosure including a shaped portion for housing an item of memorabilia of substantially similar shape desired for display and a mounting region extending about the shaped portion;

wherein the opening in the protective external layer receives the shaped portion of the memorabilia enclosure to enable the shaped portion to extend outwardly from the opening in an assembled condition, and the mounting region rests between the protective layer and substrate so as to retain an item of memorabilia housed within the shaped portion for display in three dimensions.

In a fourth aspect of the invention there is disclosed a method of protecting and displaying an item of memorabilia including:

providing an assembly including:

a first support substrate having an outer surface and oppositely facing surface;

a second protective external layer, the protective external layer adapted to be at least partially co-extensively mounted to the first substrate, the external layer further including an opening;

a memorabilia enclosure at least partially transparent having a shaped portion adapted to be received within the opening, the shaped portion providing a housing for an item of memorabilia of similar shape, the shaped portion ending in an annular peripheral edge;

the method includes inserting the shaped portion through the opening, placing the item of memorabilia within the shaped portion, mounting the external layer on to the substrate wherein the peripheral annular edge rests between the external layer and substrate, adjacent the opening, so as to retain the enclosure within the assembly and display the item of memorabilia within the shaped potion of the enclosure in three dimensions.

In a fifth aspect of the invention there is disclosed an assembly for displaying an item of memorabilia in three-dimensions including:

a rigid support substrate for mounting on a wall;

a protective layer adapted to co-extensively abut a part of a surface of the rigid support, said protective layer including an opening therein;

a memorabilia display housing, said housing including a shaped portion to receive a three-dimensional shaped item of memorabilia of similar size to the shaped portion, said shaped portion having at least a transparent or translucent viewing part;

and in an assembled condition a part of the housing is held by the protective layer or the rigid support and an item of memorabilia is received within the shaped portion of the housing so as to enable display in a three-dimensional form.

A major advantage of this aspect of the invention is that the rigid support does not need an opening, thus labour costs associated with performing a cut to provide an opening are avoided.

Preferably the memorabilia display housing includes an annular flange that abuts an area adjacent the opening in the protective layer and is held in sandwich relation between the protective layer and rigid support in an assembled condition.

Preferably the memorabilia display housing includes a neck portion for engaging the opening in the protective layer, said neck portion being resiliently biased to enable first compression of the housing for insertion of the flange within the opening and a second action to bias the neck against the opening to form a securely removable fit.

The advantage of this arrangement is four-fold. Firstly the item of memorabilia may preferably be held within the shaped portion above the surface of the protective layer. Secondly the resiliency of the neck portion enables the memorabilia housing to be inserted from above or below the opening. Thirdly the memorabilia housing may be readily removed from the assembly and fourthly the resilient bias allows the housing to be securely fitted within the opening.

Preferably the neck portion is interposed between the shaped portion and the annular flange. More preferably the neck is formed at a junction between the annular flange and shaped portion.

Preferably the shaped portion of the memorabilia housing is molded so as to substantially conform to the shape of an item of memorabilia to be received therein. Preferably the shaped portion of the housing extends from the neck portion.

Preferably the memorabilia housing is fabricated from a rigid scratch-resistant material such as hard plastics or glass.

Preferably the rigid substrate further includes a means for engaging the annular flange of the housing so as to enable fastening in a particular position.

Preferably the protective layer is rigid and transparent.

Preferably the memorabilia housing occupies an area of the support layer less than the total area of the support.

Preferably the protective layer includes a planar region about the opening which planar region co-extensively abuts the surface of the support. The benefit of the planar region is that it enables plaques and conventional commemorative articles to be mounted on to the support so as to provide descriptive information about the item of memorabilia on display.

In a sixth aspect of the present invention there is disclosed an assembly for displaying an item of memorabilia in three-dimensions including:

a rigid planar support substrate for mounting on a wall, said support being adapted to provide a surface area(s) thereon for mounting a plaque or other descriptive material;

a see through protective layer adapted to co-extensively abut a part of the surface of the rigid support on which a plaque or other descriptive material is mounted so as to enable viewing by an observer, said protective layer including an opening therein;

a memorabilia display housing having at least a transparent or translucent viewing part, said housing including a shaped portion adapted to receive a three-dimensional shaped item of memorabilia of similar size to the shaped portion, said shaped portion ending in an annular flange which abuts an area adjacent the opening in the protective layer when said assembly is fully assembled;

and in an assembled condition the annular flange of the housing is held in a sandwich relation by the protective layer and the rigid support and an item of memorabilia is received within the shaped portion of the housing so as to enable display in a three-dimensional form.

DETAILED DESCRIPTION OF THE PREFERRED EMBODIMENT

Figure 1:
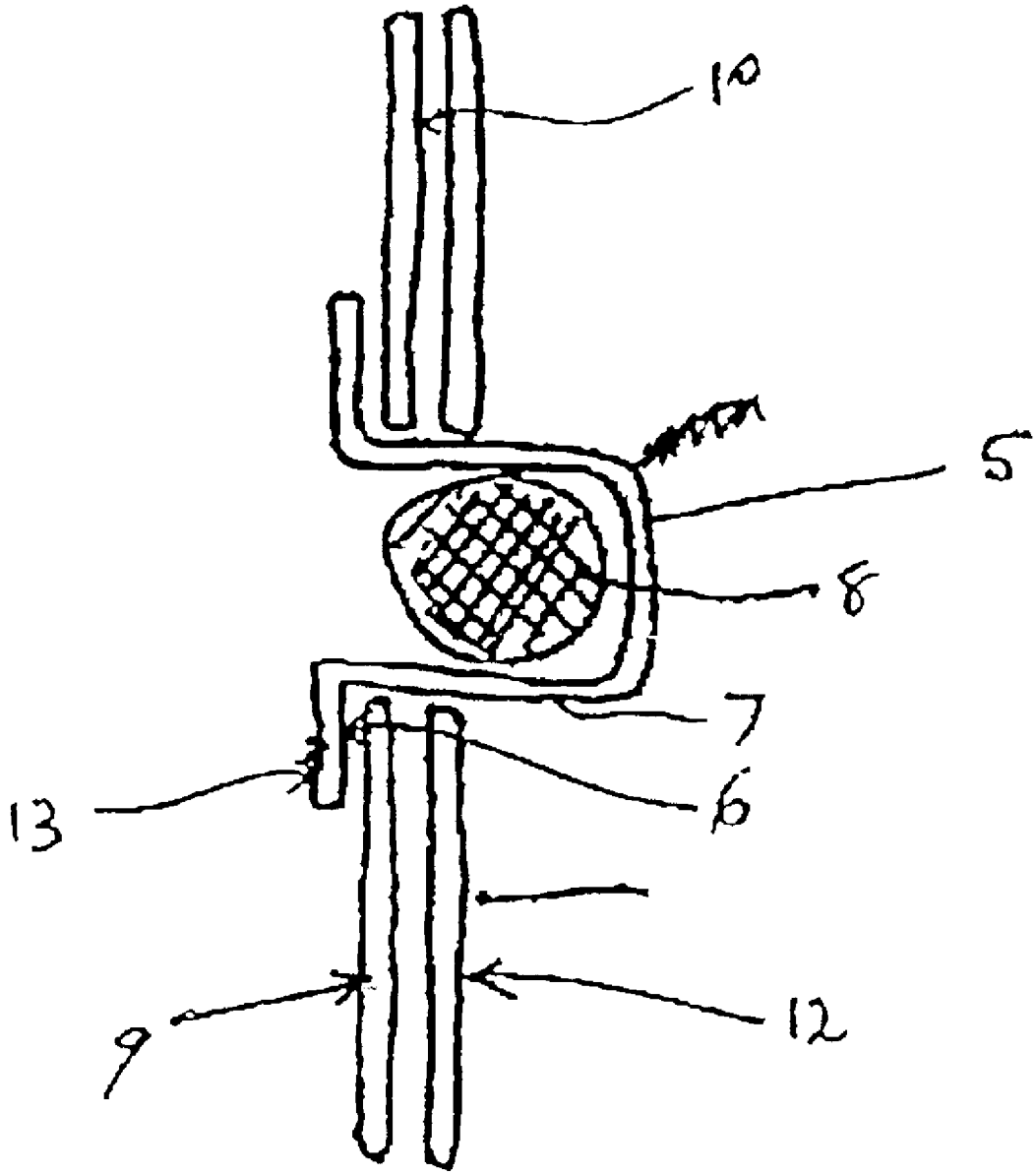
FIG. 1 is a cross-sectional view of an assembly of the invention.
Figure 2:
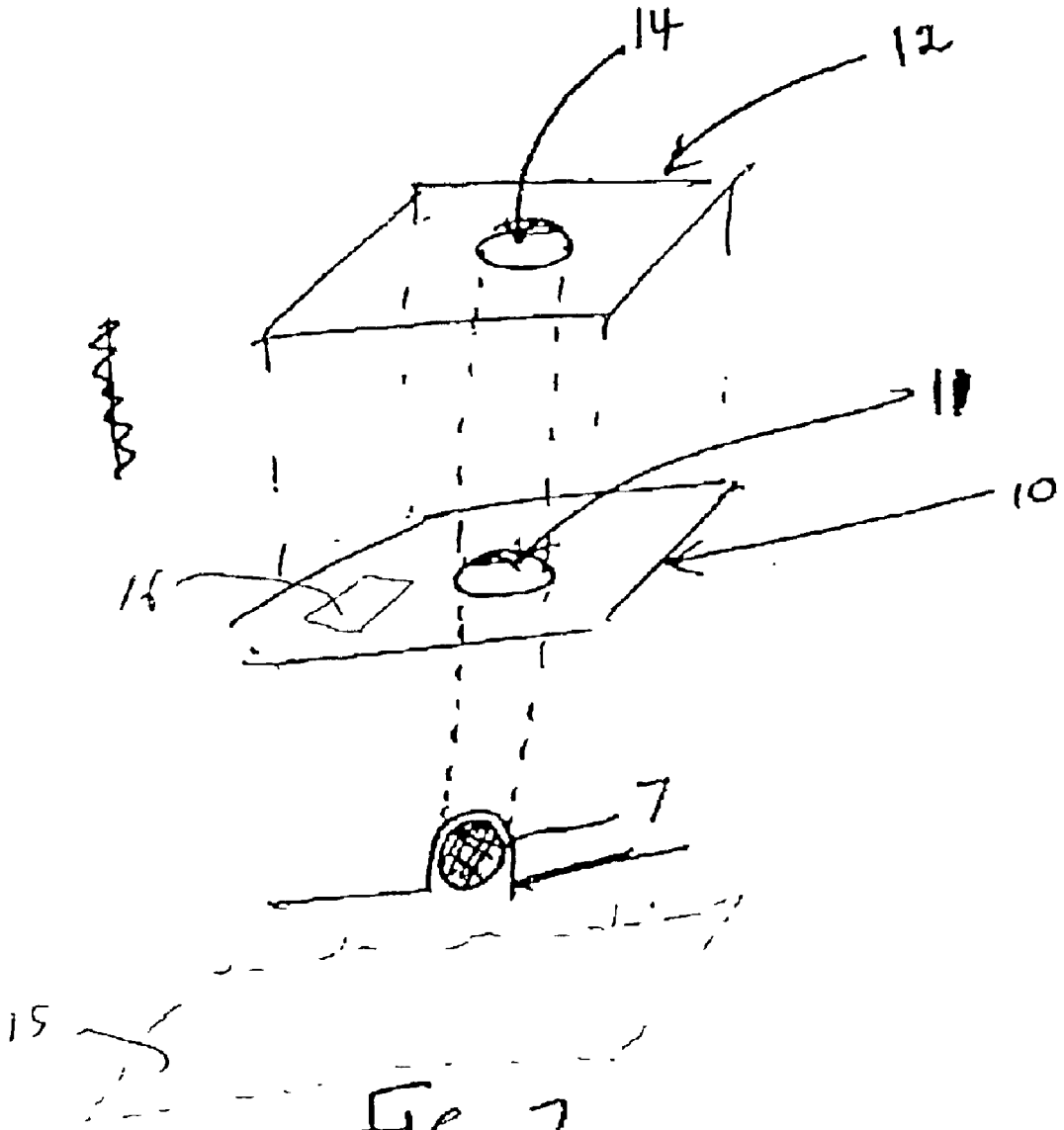
FIG. 2 is a perspective view of a transparent layer juxtaposed in relation to the first substrate.

Referring to FIGS. 1 and 2, there is illustrated an assembly according to the invention adapted to display a spherical ball such as a golf ball.

Turning to FIG. 1 there is shown a display enclosure 5 which consists of a planar portion 6 from which there extends upwardly at right angles a blister 7 for retaining therein a golf ball 8 or otherwise item of memorabilia of like shape. In the applicants' discussion of the prior art, they have highlighted major imperfections with the planar section manifest during the moulding process. This has presented a major disadvantage because the planar portion of the memorabilia display enclosure of the prior art remains in full view.

The above disadvantage is overcome by abutting the planar section 6 against the inner surface 9 of the first substrate 10 so that any flaws in the planar section are hidden from view. The first substrate 10 is preferably fabricated from a paper composite material and includes a circular opening 11 to receive the blister 7 in snug relation. It is of course understood that the opening may be of any desired shape to allow retention of any particular item of memorabilia.

The assembly according to FIG. 1 also includes a cover 12 which has an opening 14 disposed therein to correspond to the opening in the first substrate 10. The cover 12 is shown in juxtaposition on top of the first substrate 10 and is coextensively adhered thereto. In this embodiment the cover 12 is selected from glass which exhibits significantly higher resistance to scratching than corresponding planar regions in the Applicants' admitted art.

Ordinarily the display enclosure 5 exhibits a secure/snug fit within openings in both first substrate 10 and cover 12 so that the need for a backing is not necessarily required. Alternatively the assembly can indeed further include a backing (shown in phantom in FIG. 2) which backing abuts planar surfaces 13 of the display enclosure 5 so as to self-encapsulate the item of memorabilia within the apparatus.

In the preferred embodiment the first substrate 10 can include a plaque or descriptive material 16 so as to provide an explanation of the item of memorabilia.

Figures 3, 4:
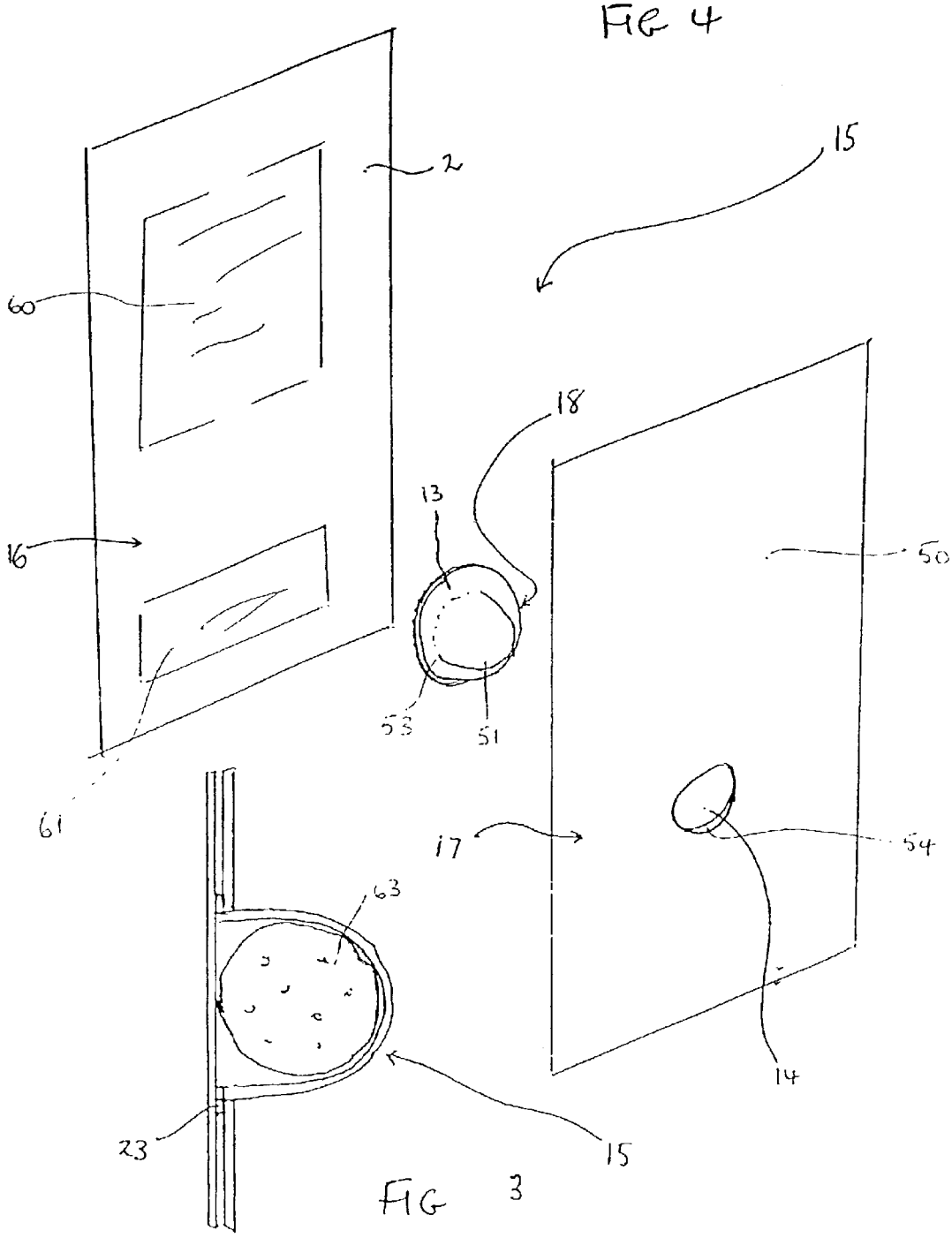
FIG. 3 is a cross sectional view of the assembly wherein the mounting portion is circular.
FIG. 4 is an assembly in perspective view including the mounting portion of FIG. 3

With reference to FIGS. 3 and 4 there is shown an alternate preferred embodiment of the invention. In this embodiment the assembly 15 includes a support substrate 16, fabricated from masonry board, on which there is mounted a hard transparent plastic protective layer 17 relative to the enclosure 18. The protective layer 17 includes a planar region 50 surrounding an opening 14 which planar region is intended to be co-extensively mounted to corresponding surface area(s) of the support 16 where a plaque 60 or other descriptive material 61 may be displayed so as to explain the item of memorabilia. It is notable, with reference to FIG. 4 that the ratio of the area of the opening 14 to the area of the planar section 50 is about 1:10. It is to be understood that this ratio can vary depending on the size of the item of memorabilia, and the corresponding opening to receive the housing, although at least a portion of the protective layer should include a planar region. The transparent planar region 50 serves to enable plaques 60 and other descriptive material 61 if present to be viewed by an observer to explain the nature of the item of memorabilia. The protective layer is mounted on to the substrate and preferably fastened thereto by means of an adhesive (PSA). The adhesive can be pre-applied to the planar regions of the protective plastic layer by means of a thin peel able paper layer which when required can be removed so as to expose a fresh surface of adhesive.

According to the assembly referred to in FIGS. 3 and 4 the memorabilia enclosure 18 consists of a mounting portion shown as a circular flange 13 and a shaped viewing portion 51 adapted to receive an item of memorabilia. In an assembled condition the circular flange 13 abuts the periphery of the opening 14 and is sandwiched 23 firmly between the hard transparent layer 17 and support substrate 16. This arrangement prevents inadvertent removal of the memorabilia housing 18 by virtue of the flange being larger than the corresponding opening 14 in the protective layer 17. The enclosure 18 also includes a neck portion 53 at the junction of the flange and the shaped portion of the enclosure which is engages walls 54 in the opening 14. The neck is preferably resiliently biased so that by physically compressing the neck the flange is able to be inserted within the opening, thereafter the neck rests firmly against walls 54 of the opening 14. The enclosure in this embodiment has the advantage of being able to be removed from an assembled condition.

Figures 5, 6:
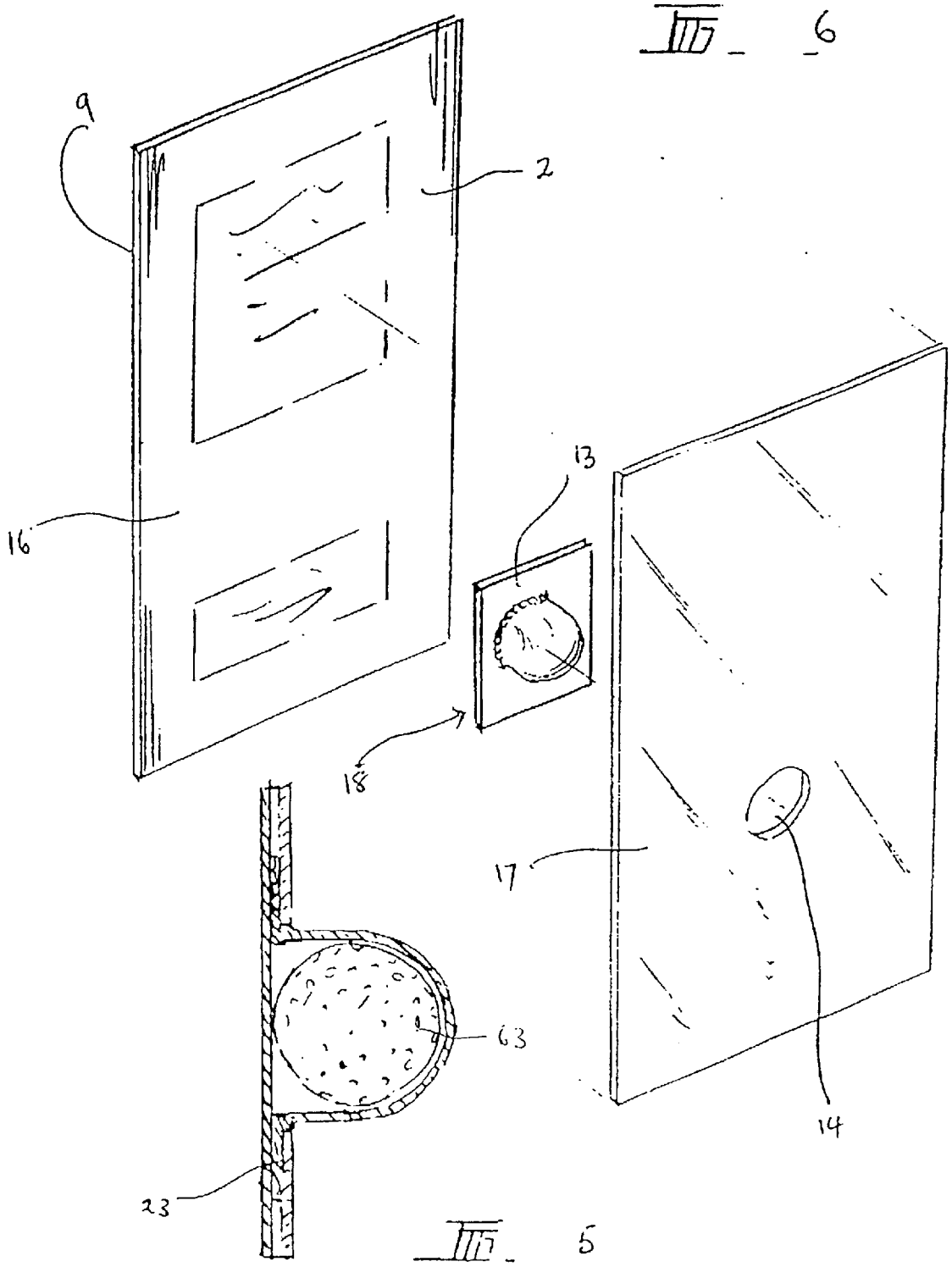
FIG. 5 is a cross sectional view of the assembly including a planar mounting portion.
FIG. 6 is a perspective view of FIG. 5 showing mounting portion in sandwich relation.

Similarly with reference to FIGS. 5 and 6 the mounting flange portion 13, which is shown in planar configuration, is sandwiched 23 between the support substrate and the protective layer. In a further embodiment the support substrate 16 may include an engagement means (not shown) on the viewing surface 2 for engaging the circular or planar mounting flange 13 so as to optimally retain the enclosure within the assembly. In yet a further embodiment the support substrate may incorporate a groove or opening (not shown) in the viewing surface to accommodate the mounting portion of the enclosure.

Figures 7, 8:
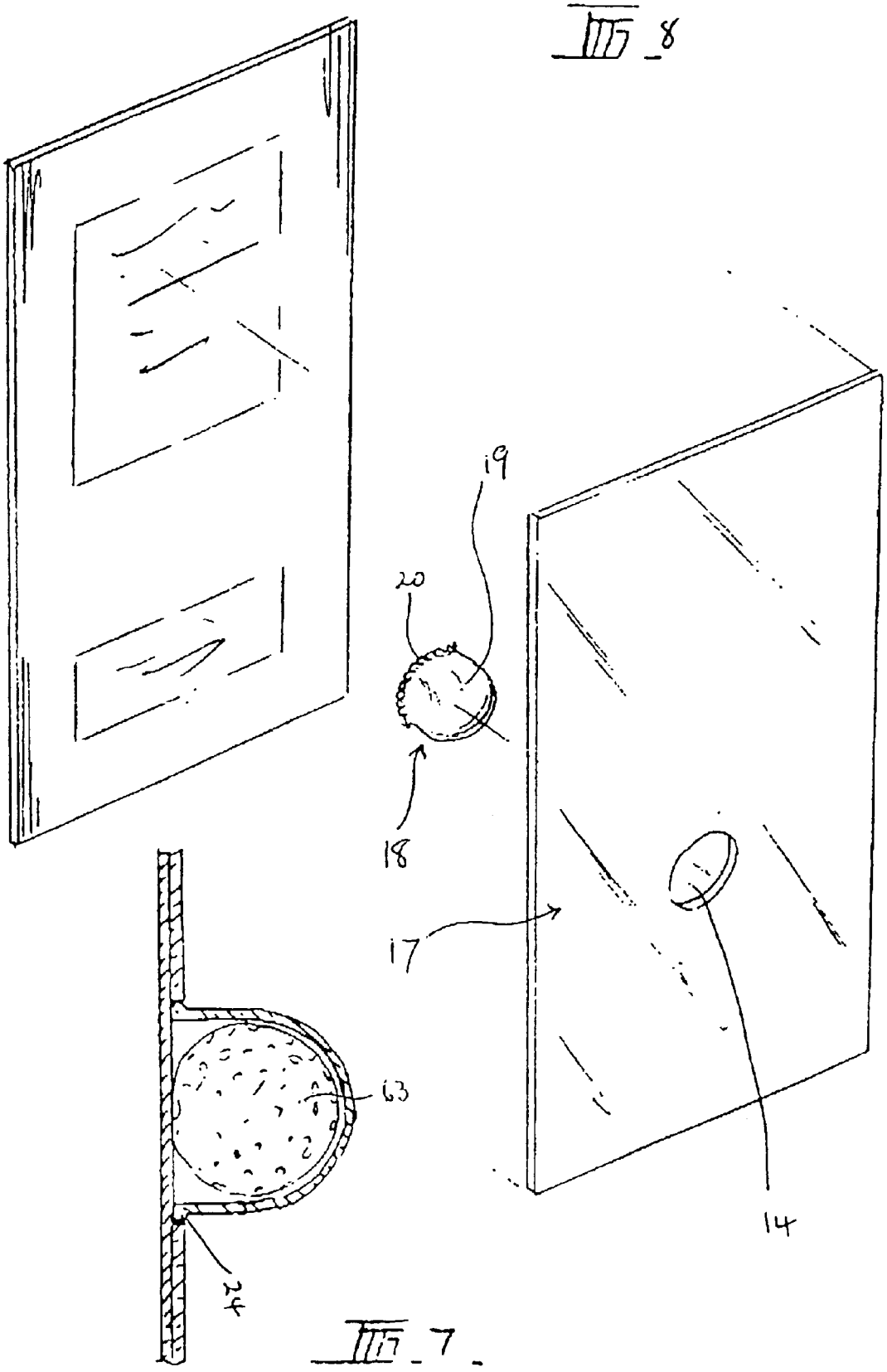
FIG. 7 is a cross sectional view of the assembly showing knurled edge in wedged engagement.
FIG. 8 is a perspective view of FIG. 7.

The assembly according to FIGS. 7 and 8 includes a transparent plastic memorabilia enclosure 18, which as shown has a moulded shaped viewing portion 19 of similar shape to golf ball 63 ending in a mounting region in the form of an annular knurled or knurled edge 20. The enclosure 18 is securely retained within the assembly because (a) the knurled edge 20 is wedged 24 between the opening 14 in the protective layer 17 and the support and (b) the knurled edge provides the enclosure with an external diameter, which is slightly greater than the diameter of the opening. Fastening with a conventional adhesive may strengthen the wedging action of the knurled edge.

In the embodiments illustrated in FIGS. 3 to 10 the support substrate does not include an opening. The protective layer on the other hand has an opening 14 through which either the shaped viewing region 19 or the flange 13 of the enclosure 18 may be inserted to attain an assembled condition. In a fully assembled condition the shaped portion 19 of the enclosure 18 sits proud of the protective hard plastic layer 17. The shaped region 19 as mentioned previously can be of any desired three-dimensional shape or configuration for receiving an item of memorabilia (not shown) of similar shape such as for example a golf ball, tennis ball, or cricket ball. It is also understood that the protective layer 17 may have a plurality of separate openings if necessary to enable more than one item of memorabilia to be displayed in a single assembly.

Figures 9, 10:
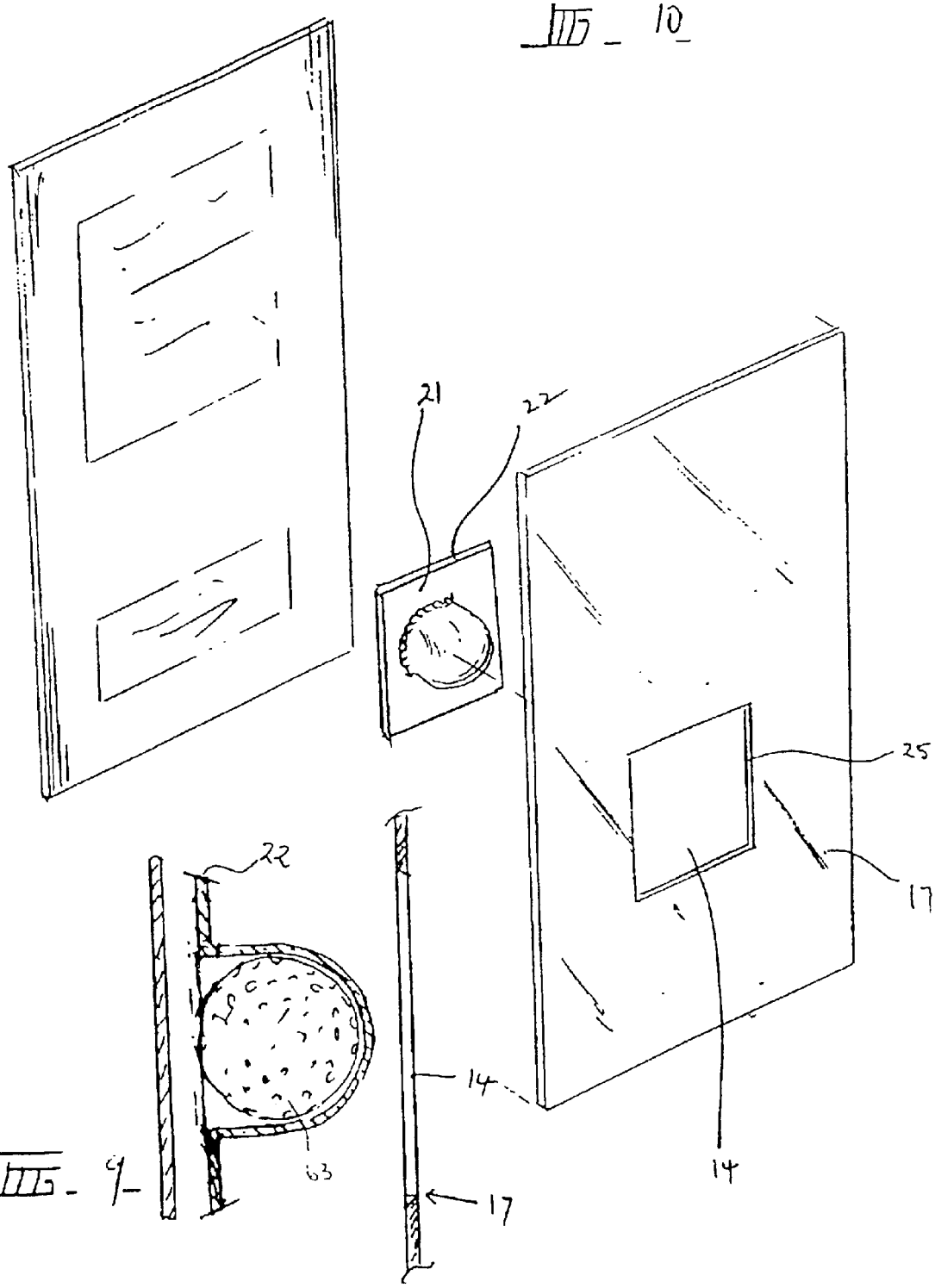
FIG. 9 is a cross sectional view of the assembly showing a tapered mounting portion.
FIG. 10 is a perspective view of the assembly according to FIG. 9

Referring to FIGS. 9 and 10 there is shown an assembly in which the opening 14 in the protective layer 17 is tapered 25 and the mounting planar flange portion 21 includes a complimentary mating element 22, best seen in FIG. 9. In a preferred embodiment the mating element of the flange portion can be formed integral with the shaped portion of the enclosure. While this embodiment is shown in reference to both a rectangular opening and mounting portion it is to be understood that the same concept applies equally for any geometry such as circular.

What is claimed is:

1. An improved assembly for protecting and displaying an item in three-dimensions including:

a support substrate;

a protective external layer which mounts at least partially co-extensively on to the first substrate, the protective layer further including an opening, the opening being tapered;

a memorabilia enclosure at least partially transparent, the enclosure including a shaped portion for housing an item of memorabilia of substantially similar shape desired for display and a tapered mounting region extending about the periphery of the shaped portion which cooperates with the tapered opening in the protective layer;

wherein in an assembled condition the shaped portion of the memorabilia enclosure extends through the opening in the protective external layer and the tapered mounting region abuts the tapered opening in the protective layer between the protective layer and substrate so as to retain an item of memorabilia housed securely within the shaped portion for display in three dimensions.

2. A method of protecting and displaying an item of memorabilia including: providing an assembly including:

a first support substrate having an outer surface and oppositely facing surface;

a second protective external layer, the protective external layer adapted to be at least partially co-extensively mounted to the first substrate, the external layer further including an opening;

a memorabilia enclosure being at least partially transparent, said enclosure having a shaped portion adapted to be received through the opening in the protective layer, the shaped portion providing an internal cavity for housing an item of memorabilia of similar shape, the shaped portion ending in an annular peripheral flange which is retained between the support substrate and the protective layer, the enclosure further including a neck portion between the flange and shaped portion, which is larger than the opening in the protective layer, the neck being resiliently biased for insertion and retention of the shaped portion within the opening;

the method including the steps of applying an external force at or near the neck of the enclosure to assist insertion of the shaped portion through the opening in the external layer thereafter releasing the applied force so that the neck is biased towards positive engagement with walls of the external layer defining the opening, placing an item of memorabilia within the internal cavity, mounting the external layer on to the substrate thereby encasing the peripheral annular flange between the external layer and substrate, adjacent the opening, whereby the enclosure is secured within the opening as the neck is biased against the walls defining the opening in the protective layer after release of the applied force thereby displaying the item of memorabilia within the shaped portion of the enclosure in three dimensions.

3. An improved assembly according to claim 1 wherein the mounting region is a knurled annular edge, which extends about the periphery of the shaped portion.

4. An improved assembly according to claim 1 wherein the support substrate incorporates a groove or opening therein to accommodate the tapered mounting portion of the memorabilia enclosure.

5. An assembly for displaying an item of memorabilia in three-dimensions including:

a rigid support substrate for mounting on a wall;

a protective layer adapted to co-extensively abut a part of a surface of the rigid support, said protective layer including an opening therein;

a memorabilia display enclosure fabricated from a rigid scratch-resistant material selected from the group consisting of hard plastics or glass, said memorabilia display enclosure including a shaped portion, which extends through the opening in the protective layer in an assembled condition, said shaped portion having an internal cavity adapted to receive a three-dimensional item of memorabilia of similar shape, said shaped portion having at least a transparent or translucent viewing part, ending in an annular peripheral flange which is larger than the opening in the protective layer;

and in an assembled condition the annular flange of the memorabilia display enclosure sits adjacent the opening and is held between the rigid support and the protective layer so that an item of memorabilia which is received within the internal cavity of the shaped portion of the enclosure is securely displayed in a three-dimensional form.

6. An assembly according to claim 5 wherein the memorabilia display enclosure includes a neck portion between the shaped portion and the annular flange, which is equal to or larger than the opening in the protective layer, the neck being resiliently biased to enable insertion of the shaped portion through the opening in a first condition and retention of the shaped portion within the opening in a second biased condition by means of positive engagement between the neck portion and walls defining the opening.

7. An assembly according to claim 5 wherein the rigid substrate further includes a means for engaging the annular flange of the memorabilia display enclosure so as to enable fastening in a particular position.

8. An assembly according to claim 5 wherein the protective layer is rigid and transparent.

9. An assembly for displaying an item of memorabilia in three-dimensions including:

a rigid planar support substrate for mounting on a wall, said support being adapted to provide a surface area(s) thereon for mounting a plaque or other descriptive material;

a see through protective layer adapted to co-extensively abut at least a part of the surface of the rigid support on which a descriptive material is mounted so as to enable viewing of the descriptive material by an observer, said protective layer including an opening therein;

a memorabilia display enclosure fabricated from a rigid scratch-resistant material selected from the group consisting of hard plastics or glass, said enclosure having at least a transparent or translucent viewing part, said enclosure including a shaped portion, which extends through the opening in the protective layer in an assembled condition, said shaped portion having an internal cavity adapted to receive a three-dimensional shaped item of memorabilia of similar size and shape, said shaped portion ending in an annular flange which abuts an area adjacent the opening in the protective layer when said assembly is fully assembled;

and in an assembled condition the annular flange of the enclosure is held in a sandwich relation by the protective layer and the rigid support and an item of memorabilia is received within the internal cavity of the shaped portion of the enclosure u so as to enable display in a three-dimensional form.

10. An assembly for displaying an item of memorabilia in three-dimensions according to claim 9 wherein the memorabilia display enclosure includes a neck section between the shaped portion and the annular flange, the neck section being resiliently biased to assist insertion of the shaped portion through the opening in the external layer in a first condition and thereafter securing the memorabilia display enclosure within the opening by positively engaging walls defining the opening in the protective layer.

11. An assembly for displaying an item of memorabilia in three-dimensions according to claim 10 wherein the neck portion between the flange and shaped portion is larger than the opening in the protective layer such that the neck is resiliently biased to allow insertion of the shaped portion through the opening in a first insertion condition and positive engagement of walls of the protective layer defining the opening in a second biased condition.

12. An assembly for displaying an item of memorabilia including:

a first support substrate having an outer surface and oppositely facing surface;

a second protective external layer, the protective external layer adapted to be at least partially co-extensively mounted to the first substrate, the external layer further including an opening;

a memorabilia enclosure fabricated from a rigid scratch-resistant material selected from the group consisting of hard plastics or glass being at least partially transparent, said enclosure having a shaped portion adapted to extend through the opening in the protective layer, the shaped portion providing an internal cavity for housing an item of memorabilia of similar shape therein, the shaped portion ending in an annular peripheral edge which is retained between the support substrate and the protective layer in an assembled condition, the enclosure further including a neck portion between the edge and shaped portion, which is larger than the opening in the protective layer, the neck being resiliently biased for insertion and retention of the shaped portion within the opening;

whereby the enclosure is secured within the opening as the neck is biased against the walls defining the opening in the protective layer following insertion.

13. An improved assembly for protecting and displaying an item in three-dimensions including:

a support substrate;

a protective external layer which mounts at least partially co-extensively on to the first substrate, the protective layer further including an opening;

a memorabilia enclosure at least partially transparent, the enclosure including a shaped portion for housing an item of memorabilia of substantially similar shape desired for display and a mounting region extending about the shaped portion;

wherein in an assembled condition the shaped portion of the memorabilia enclosure extends through the opening in the protective external layer and the mounting region abuts the opening in the protective layer between the protective layer and substrate so as to retain an item of memorabilia housed within the shaped portion for display in three dimensions; and wherein the mounting region is a knurled annular edge, which extends about the periphery of the shaped portion.

* * * * *